US007938678B1

(12) United States Patent
Lee et al.

(10) Patent No.: US 7,938,678 B1
(45) Date of Patent: May 10, 2011

(54) SOCKET MEMBER

(75) Inventors: Kuo-Chi Lee, Taipei County (TW); Chin-Huang Lin, Taipei County (TW)

(73) Assignee: Concraft Holding Co., Ltd., Grand Cayman (KY)

( * ) Notice: Subject to any disclaimer, the term of this patent is extended or adjusted under 35 U.S.C. 154(b) by 0 days.

(21) Appl. No.: 12/820,501

(22) Filed: Jun. 22, 2010

(30) Foreign Application Priority Data

May 14, 2010 (TW) ..... 99209028 U

(51) Int. Cl.
*H01R 13/60* (2006.01)

(52) U.S. Cl. ..... 439/541.5; 439/579

(58) Field of Classification Search ..... 439/79, 439/80, 83, 541.5, 579
See application file for complete search history.

(56) References Cited

U.S. PATENT DOCUMENTS

| | | | | |
|---|---|---|---|---|
| 6,132,244 | A * | 10/2000 | Leeman et al. | 439/541.5 |
| 6,540,551 | B1 * | 4/2003 | Wang | 439/541.5 |
| 6,679,728 | B1 * | 1/2004 | Huang et al. | 439/579 |
| 2004/0259413 | A1 * | 12/2004 | Chou et al. | 439/541.5 |
| 2006/0134973 | A1 * | 6/2006 | Wang | 439/541.5 |

* cited by examiner

*Primary Examiner* — Briggitte R Hammond
*Assistant Examiner* — Larisa Z Tsukerman
(74) *Attorney, Agent, or Firm* — Rosenberg, Klein & Lee

(57) ABSTRACT

A socket member includes an insulated body, one connection unit disposed within the insulate body and one transmission terminal. The connection unit includes a connection body having a first side formed with a through hole and a fixing seat projecting from the first side and having a reception channel in spatial communication with the through hole. The transmission terminal includes a first terminal element having a first connecting section extending into the through hole in the connection body for establishing electrical connection with an inserted plug and a clamping section received within the reception channel. The second terminal element has a second connecting section clamped by the clamping section of the first terminal element and a soldering section for soldering onto a printed circuit board.

10 Claims, 7 Drawing Sheets

SOCKET MEMBER

This application claims the benefits of the Taiwan Patent Application Serial NO. 099209028, filed on May 14, 2010, the subject matter of which is incorporated herein by reference.

BACKGROUND OF THE INVENTION

1. Field of the Invention

The present invention relates to a socket member, more particularly to a socket member that includes elongated first and second terminal elements clamped together in order to form a signal transmission terminal.

2. Description of the Prior Art

Due to rapid development in the digital electronic technology, more and more consumer electronic devices have been invented for daily use. Hence, a socket member for receiving the electronic device plays an important role since electricity is supplied via the socket member. FIG. 1 shows an exploded view of a conventional socket member.

As illustrated, the conventional socket member 1 includes an insulated body 11, a ground-contact element 12, a plurality of plastic cushion pads 13 and a plurality of signal terminals 14. The insulated body 11 has a plurality of posts 111 projecting from a first side thereof, a plurality of L-shaped channels 112 formed in a second side thereof and a plurality of slits 113 extending through the posts 111 and the L-shaped channels 112 respectively.

The ground-contact element 12 includes a planar plate 122, a plurality of metal posts 121 projecting from the planar plate 122, a plurality of through holes 123 extending through the plate and the posts 122, 121 and at least one ground terminal 124 projecting from one end of the plate 122. The ground-contact element 12 is made from metal, such as copper. The cushion pad 13 is sleeved over the metal post 121 in order to prevent deformation of the post 121 in case of an external impact. The signal terminal 14 has a first contact section 141, a second contact section 142 and a transmission section 143. The signal terminal 14 is a one-piece member and is punched integrally from a metal plate, such as copper.

After assembly, the posts 111 of the insulated body extend respectively into the through holes 123 in the ground-contact element 12, thereby coupling the insulated body and the ground-contact element 12 together. Moreover, the signal terminals 14 are respectively received within the L-shaped channels 112 in the insulated body 11 in such a manner that the first and second contact section 141, 142 of a respective signal terminal 14 are inserted into the respective slits 113, thereby mounting the signal terminals 14 within the insulated body 11. Under this condition, when a mating plug member (not shown) is inserted into the slits 113 of the insulated body 11 via the metal posts, the mating plug member will touch the first and second contact sections 141, 142 of the signal terminals 14, thereby allowing a signal transmission through the plug and socket members.

Note that when the mating plug member (not shown) touches the first and second contact sections 141, 142 of the signal terminals 14, the latter two move away from each other along the D1 and D2 directions. Since the thickness of resilient range E of the respective terminal 14 is greater than the width thereof, the terminal 14 has a low bending strength. Under this condition, frequent plug-out and plug-in operations of the mating plug relative to the socket member 1 may result in weakness in the resilient range of the terminal 14, finally leading breakage of the first and second contact sections 141, 142 in the terminals 14.

In addition, it requires tin soldering for fixing the transmission section 143 of each terminal 14 in the conventional socket member and the insulated body 11 is required to be constructed from a high-heat resistant insulated material, which, in turn, causes extra expense for the manufacturers.

FIG. 2 illustrates how the signal terminals employed in the conventional socket member are punched via the molding process. Generally, a mold (not shown) is used for punching a thin and elongated metal plate in order to form a F-shaped metal strip 10, which latter undergoes a bending process (not shown), thereby forming the signal terminal 14.

It is obvious from FIG. 2 that after the punching operation onto the thin and elongated metal plate to form the F-shaped metal strips 10, a relatively large area W is left as waste. Moreover, in the conventional socket member, the post 121, the planar plate 122 and the ground terminal 124 of the ground-contact element 12 are all made from metal and thus a lot of manufacturing expense is resulted and in fact the ground-contact element 12 is only intended for grounding purpose, there is no need to use so much amount of metal.

SUMMARY OF THE INVENTION

Therefore, the object of the present invention is to provide a socket member including a transmission terminal that can be fabricated with little waste thereof, and connection and ground terminals made from thin metal strips in order to economize the metal material.

The main object of the present invention is to provide a socket member including a transmission terminal formed by interactively clamped first and second terminal elements in such manner that the latter are designed in thin and elongated shape so that little waste will be result during punching and bending processes for fabrication of the first and second terminal elements.

Another object of the present invention is to provide a socket member including a ground terminal for grounding purpose. Since the ground terminal requires lesser metal material when compared to the prior art ones, the manufacturing expense can be lowered.

The socket member of the present invention includes an insulated body, at least one connection unit, at least one transmission terminal and a limiting plate.

The connection unit is disposed within the insulate body, and includes a connection body having a first side formed with a through hole and a fixing seat projecting from the first side of the connection body, and having a reception channel in spatial communication with the through hole.

The transmission terminal includes a first terminal element and a second terminal element. The first terminal element has a first connecting section extending into the through hole in the connection body for establishing electrical connection with an inserted plug and a clamping section received within the reception channel of the fixing seat 222. The second terminal element has a second connecting section being clamped by the clamping section of the first terminal element and a soldering section for soldering onto a printed circuit board, thereby installing the socket member on the printed circuit board.

The limiting plate is made from high-heat resistant and insulated material, and is used for holding the insulated body thereabove in such a manner that in case the socket member has several pieces of the transmission terminals, the soldering sections of the second terminal elements are fixed on the limiting plate via tin soldering process.

In the prior art socket member, the ground-contact element has large dimension and results in lots of metal plates while the signal terminals are integrally formed and thus a relatively large waste of the metal plate is resulted after the punching and bending processes. In the socket member of the present invention, the first and second terminal elements are interactively clamped together to form the transmission terminals. Since the terminal elements for formation of the transmission terminal in the present invention are elongated and thin in dimension, several pieces of semi-finished terminal elements can be punched out from the thin-and-elongated metal plates. There will be little waste resulted after fabrication of the terminal elements. Moreover, the soldering sections of the second terminal elements are used for grounding purposes and since each soldering section has a relatively small contact area, lots of metal material can be saved. Since the insulated body can be made from a less expensive and low-heat resistant insulated material, the manufacturing expense of the socket member of the present invention can be cut down.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENT

Figure 3A:
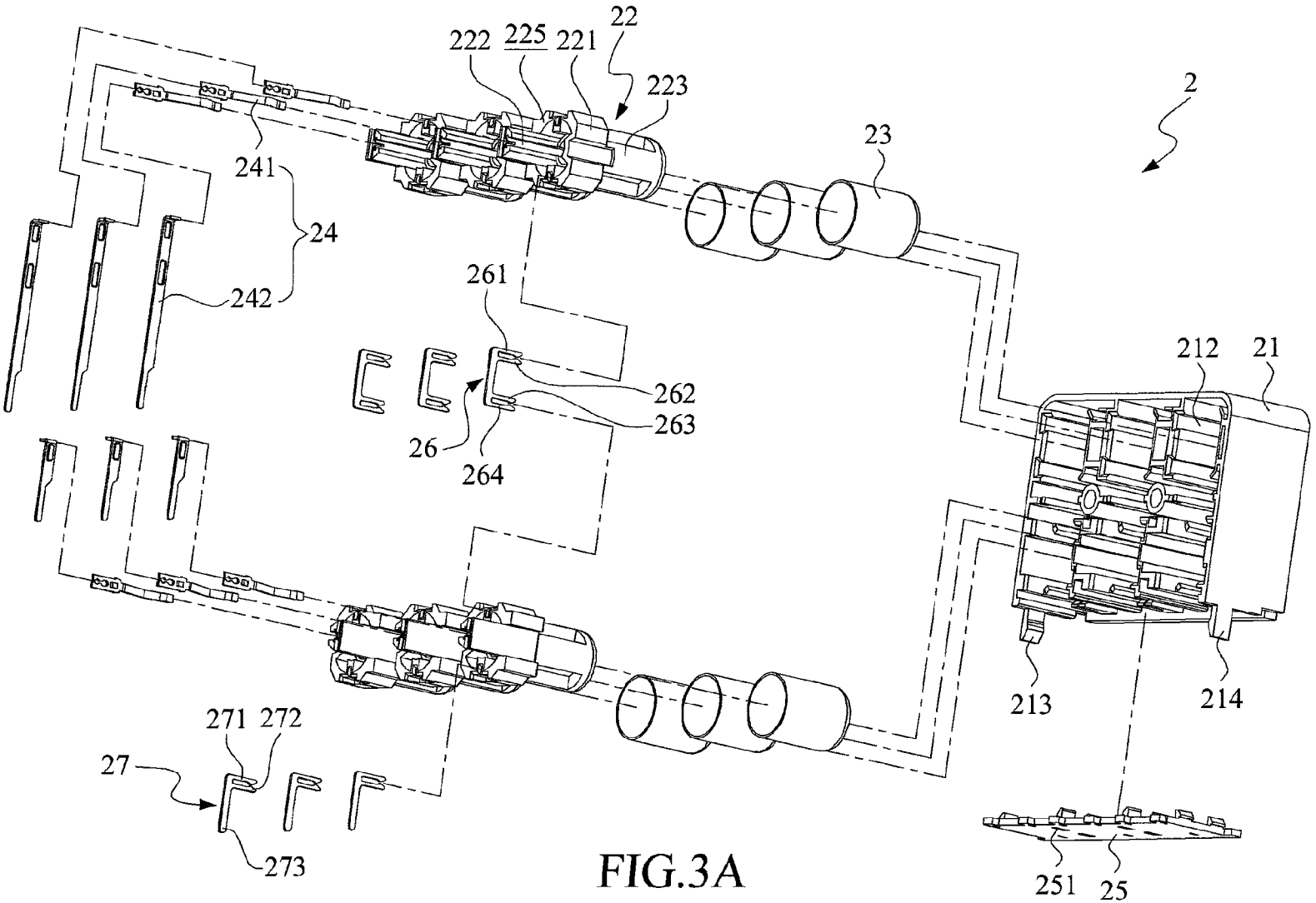
FIGS. 3A and 3B respectively show exploded views of a socket member of the present invention.
Figure 3B:
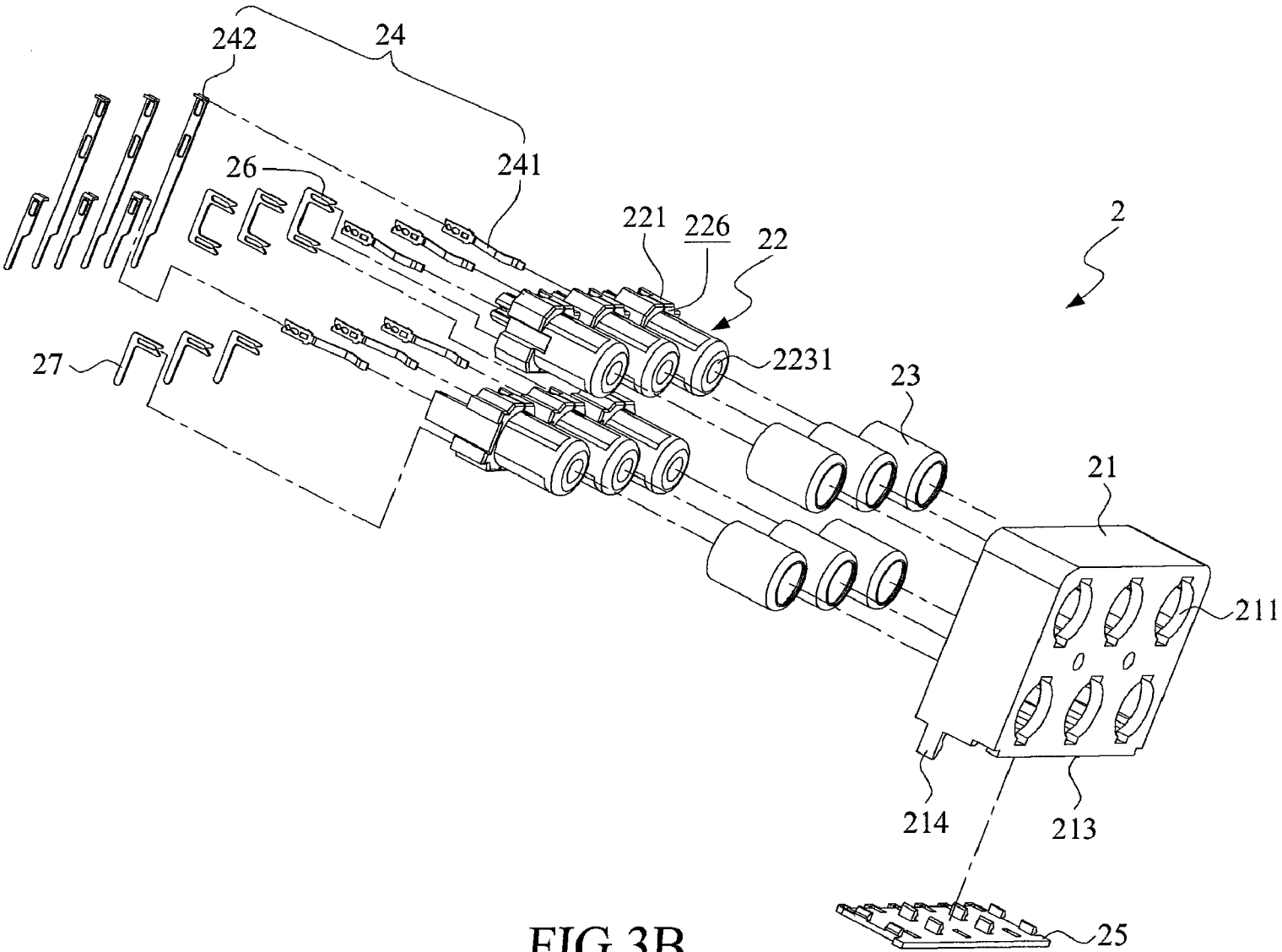
Figure 4:
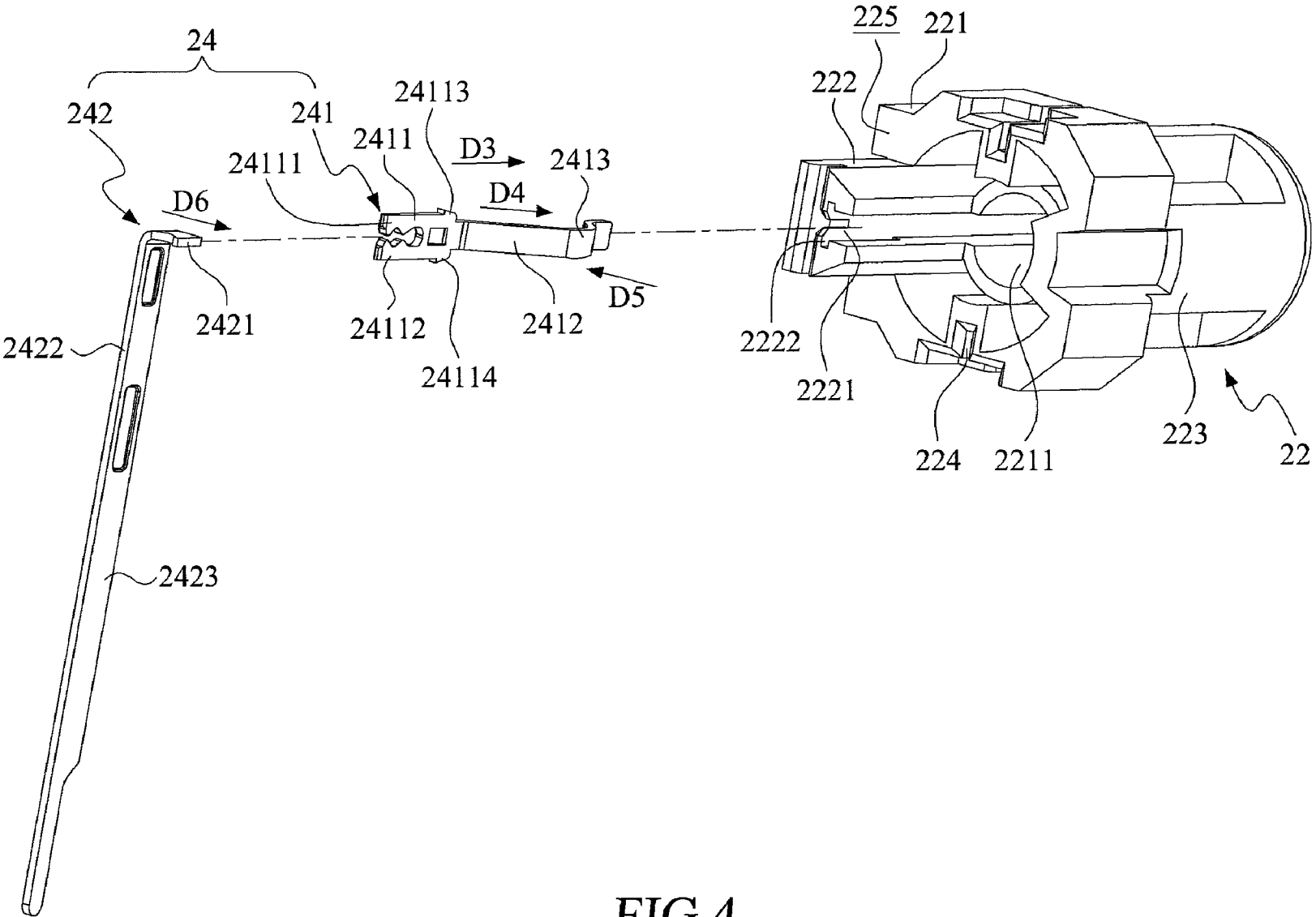
FIG. 4 show perspective views of one connection unit and transmission terminals employed in the socket member of the present invention.

Referring to FIGS. 3A, 3B and 4, wherein FIGS. 3A and 3B respectively show exploded views of a socket member of the present invention while FIG. 4 show perspective view of one connection unit and transmission terminals employed in the socket member of the present invention. As illustrated, the socket member 2 of the present invention includes an insulated body 21, a plurality of connection unit 22, a plurality of metal sleeves 23, a plurality of transmission terminal 24, a limiting plate 25, a plurality of connection terminals 26 and a plurality of ground terminals 27.

The insulated body 21 has a plurality of through holes 211 for extension of the connection units 22, a plurality of reception channels 212, and first and second fixing ends 213, 214 for fixing onto a printed circuit board (not shown). The insulated body 21 can be made from plastics material.

Each connection unit 22 is disposed within a respective reception channel 212 of the insulate body 21, is exposed from the through hole 211 thereof, and includes a connection body 221 and a fixing seat 222. The connection body 221 has a first side 225 formed with a first through hole 2211. The fixing seat 222 projects from the first side 225 of the connection body 221, and has a reception channel 2221 in spatial communication with the first through hole 2211.

The fixing seat 222 further has an engagement channel 2222 in spatial communication with and is located inboard to the reception channel 2221. The fixing seat 222 further has first and second protrusion blocks 2221B (see FIG. 4) projecting into the reception channel 2221, the purpose of which will be described later.

The connection body 221 further has a protrusion post 223 that projects outwardly from a second side 226 opposite to the first side 225 and that is formed with a second through hole 2231 in spatial communication with the first through holes 2211. The first side 225 of the connection body 221 is further formed with a plurality of clamping recesses 224 which extend through the second side 226 thereof. Each of the metal sleeves 23 is sleeved over the protrusion post 223 of the connection body 221.

Note that when the clamping section 2411 is received within the reception channel 2221, the resilient section 2412 extends along the fourth direction D4 into the first through hole 2211 in such manner that in case the first connecting section 2413 is pressed by the inserted plug member along the fifth direction D5, the resilient section 2412 absorbs a relatively large pressing force due to owing an exterior area greater than an area of cross-section, thereby preventing untimely breakage of the first terminal element 241 and hence prolonging service life thereof.

The second terminal element 242 has a body section 2422 and a second connecting section 2421 projecting perpendicularly from one end of the body section 2422 along the sixth direction D6 in such a manner that when the body section 2422 is received within the engagement channel 2222 in the fixing seat 222, the connecting section 2421 thereof is clamped securely by the first and second clamping strips 24111, 24112 of the clamping section 241 in the first terminal element 241 in order to provide effective signal transmission therethrough. The second terminal element 242 further has a soldering section 2423 projecting axially from the body section 2422 for soldering onto a printed circuit board (not shown), thereby installing the socket member on the printed circuit board.

The limiting plate 25 is formed with a plurality of limiting holes 251 into which the soldering sections 2423 of the second terminal elements 242 are to be soldered. The limiting plate 25 is preferably made from high-heat resistant and insulated material in order to withstand the tin-soldering process. In the present embodiment, the insulated body 21 is mounted detachably on the limiting plate 25 such that the former can be made from a less expensive and low-heat resistant insulated material in order cut down the manufacturing expense of the socket member of the present invention.

Each connection terminal 26 is disposed within the clamping recess 224 in the connection body 221, and has first, second, third and fourth clamping strips 261, 262, 263, 264 which cooperatively clamp electrically an adjacent pair of the metal sleeves 23.

Each ground terminal 27 has a pair of clamping strips 271, 272 for clamping one of the adjacent pair of the metal sleeves 23 and a grounding strip 273 connected to the ground, thereby grounding the adjacent pair of the metal sleeves 23 to the earth. Note that the grounding strips 273 of the ground terminals 27 may extend through the limiting holes 251 in the limiting plate 25 for grounding purpose. Since the connection and ground terminals 26, 27 are made of thin and elongated metal strips, no large amount of metal plate is required as in the prior art socket member, hence the manufacturing expense can be lowered.

Figure 5A:
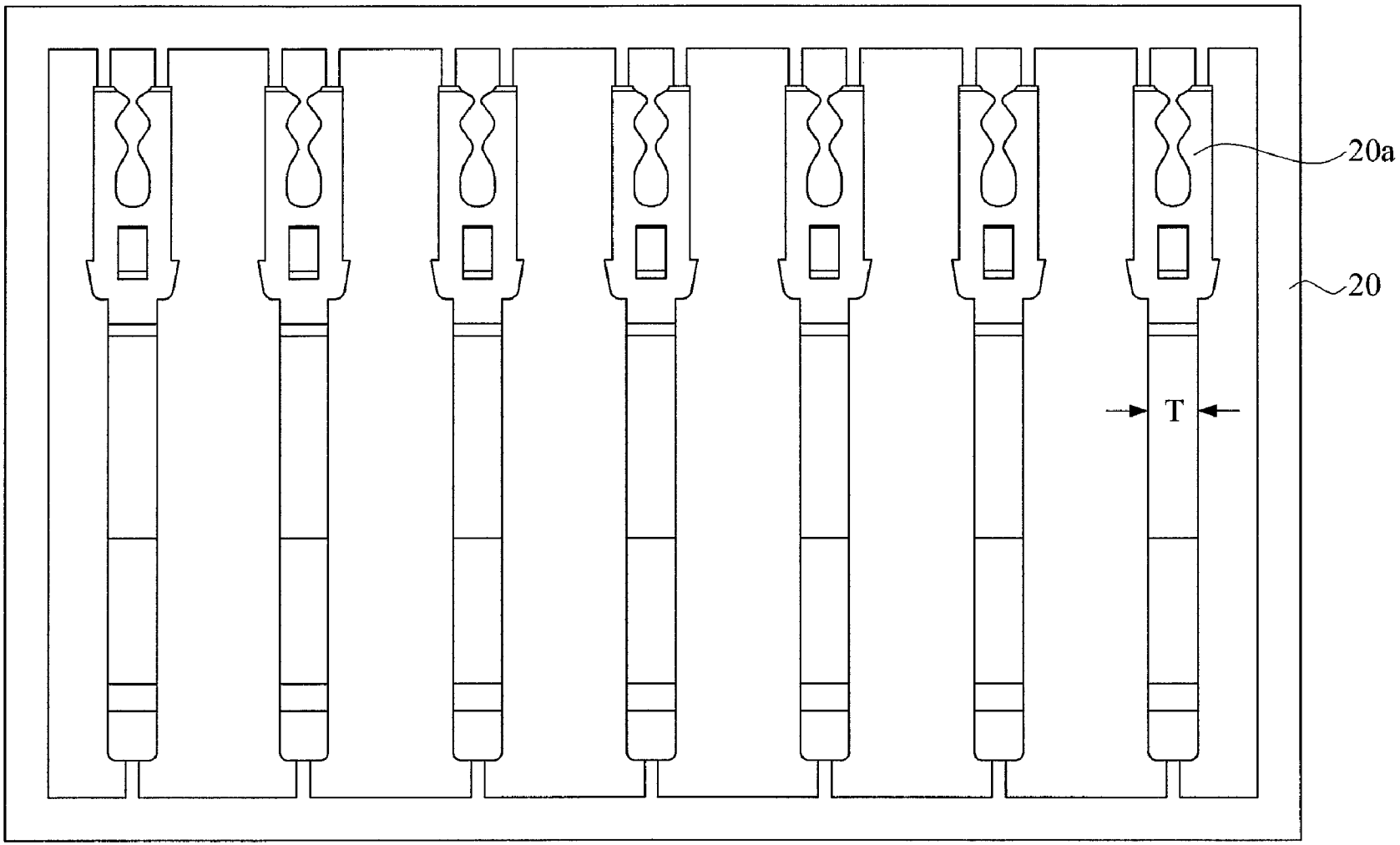
FIG. 5A illustrates how a first terminal element is punched from a first thin-and-elongated metal plate during construction of the socket member of the present invention.
Figure 5B:
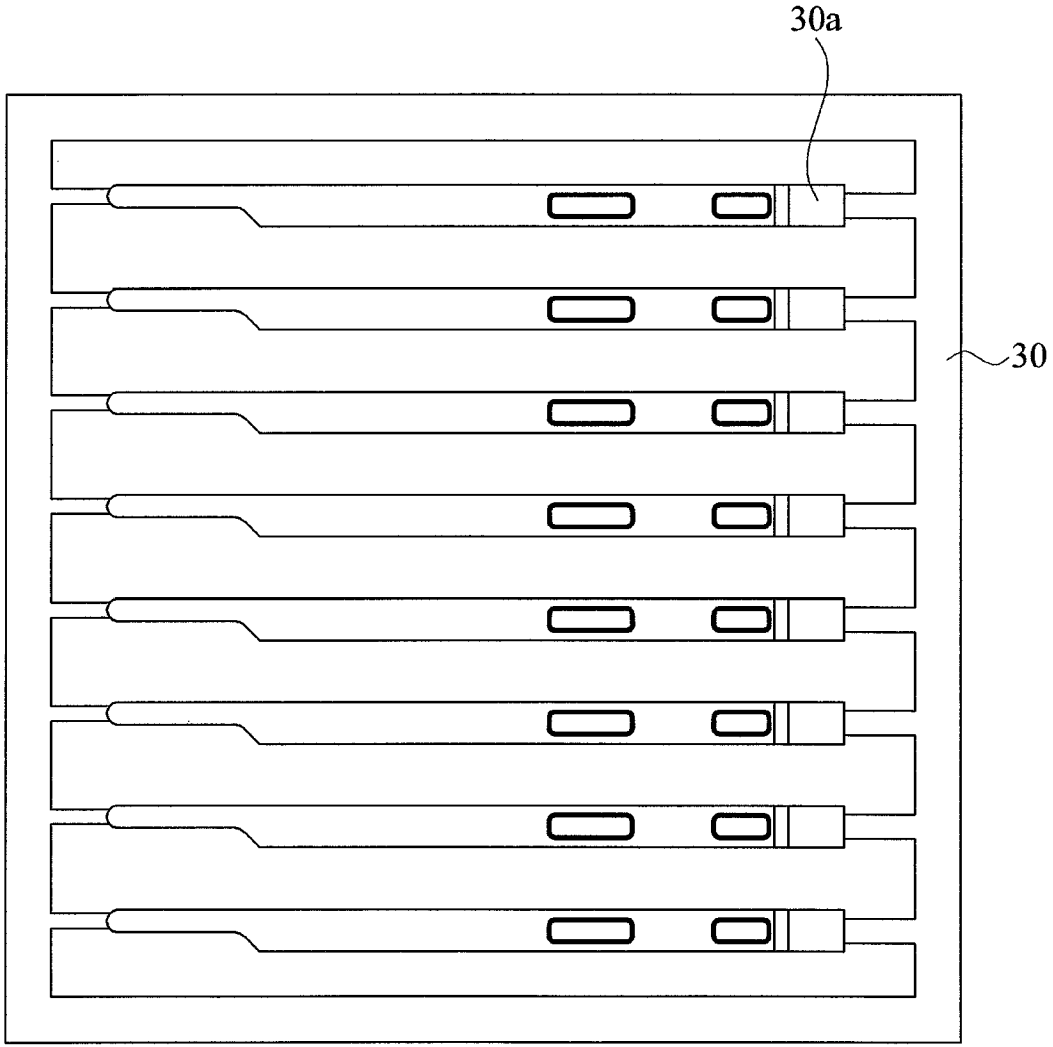
FIG. 5B illustrates how a second terminal element is punched from a second thin-and-elongated metal plate during construction of the socket member of the present invention.

Referring to FIGS. 5A and 5B, wherein FIG. 5A illustrates how the first terminal element 241 is punched from a first thin-and-elongated metal plate during construction of the socket member of the present invention while FIG. 5B illustrates how the second terminal element 242 is punched from a second thin-and-elongated metal plate during construction of the socket member of the present invention. Also referring to FIG. 3*a*, for fabrication of the first and second terminal elements 241, 242, a pressing mold (not shown) is used for punching the first thin-and-elongated metal plate 20 and the second thin-and-elongated metal plate 30 and the semi-finished terminal elements 20*a*, 30*a* are then undergone a bending process (not shown) to form the first and second terminal elements 241, 242.

An automatic machine (not shown) can be used for fixing the first terminal elements 241 onto the connection unit 22. Later, the second terminal elements 242 are coupled to the first terminal elements 241 respectively as described above in order to for the transmission terminals 24. Thus, human labor and assembling time can be economized.

In addition, please note the shape of the first and second terminal elements 241, 242 shown in FIG. 3A, since the terminal elements 241, 242 are elongated and thin in dimension, several pieces 20*a*, 30*a* can be punched out from the thin-and-elongated metal plates 20, 30. There will be little waste resulted after fabrication of the terminal elements 241, 242.

Figure 1:
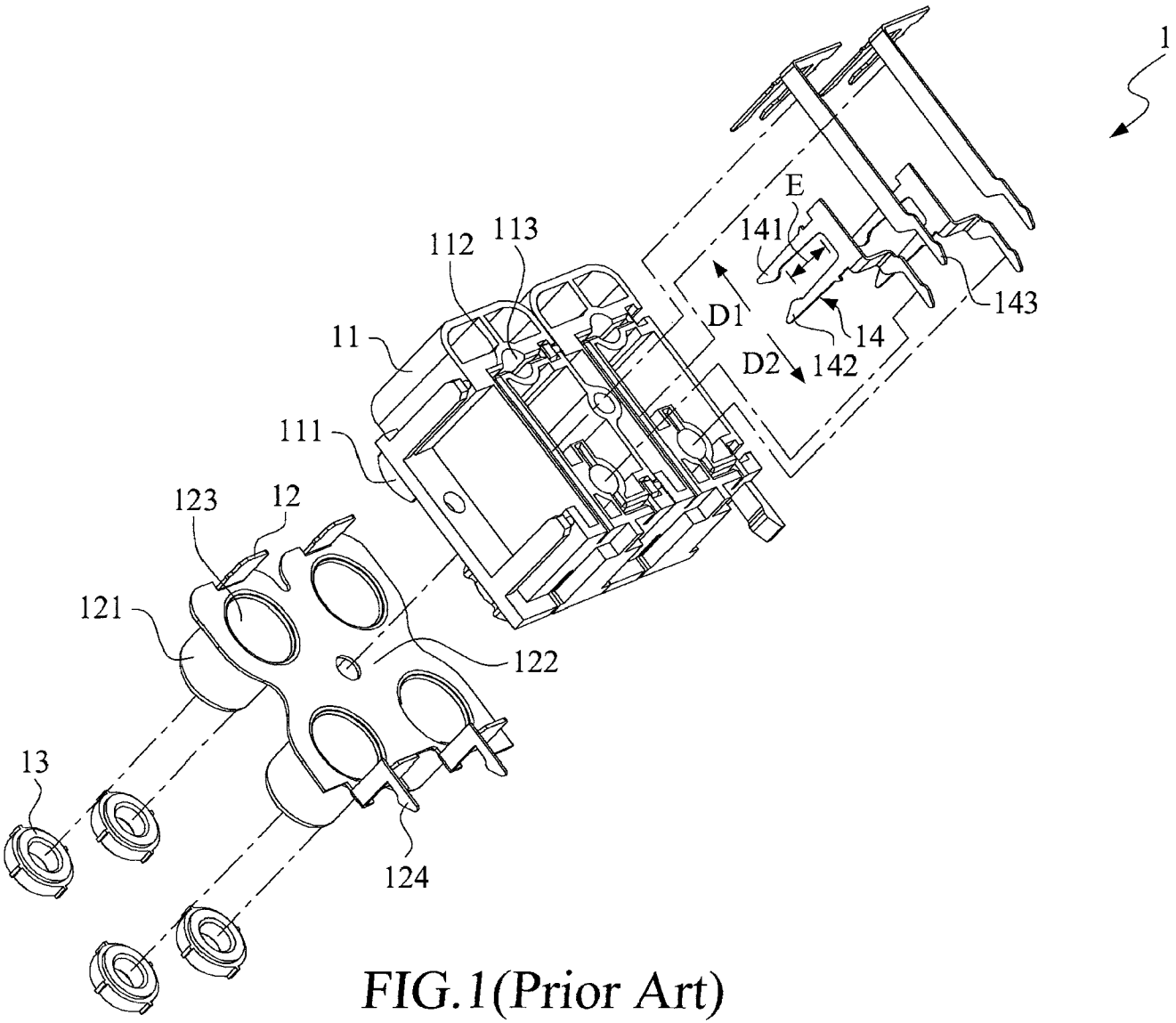
FIG.1(Prior Art)
FIG. 1 shows an exploded view of a conventional socket member.
Figure 2:
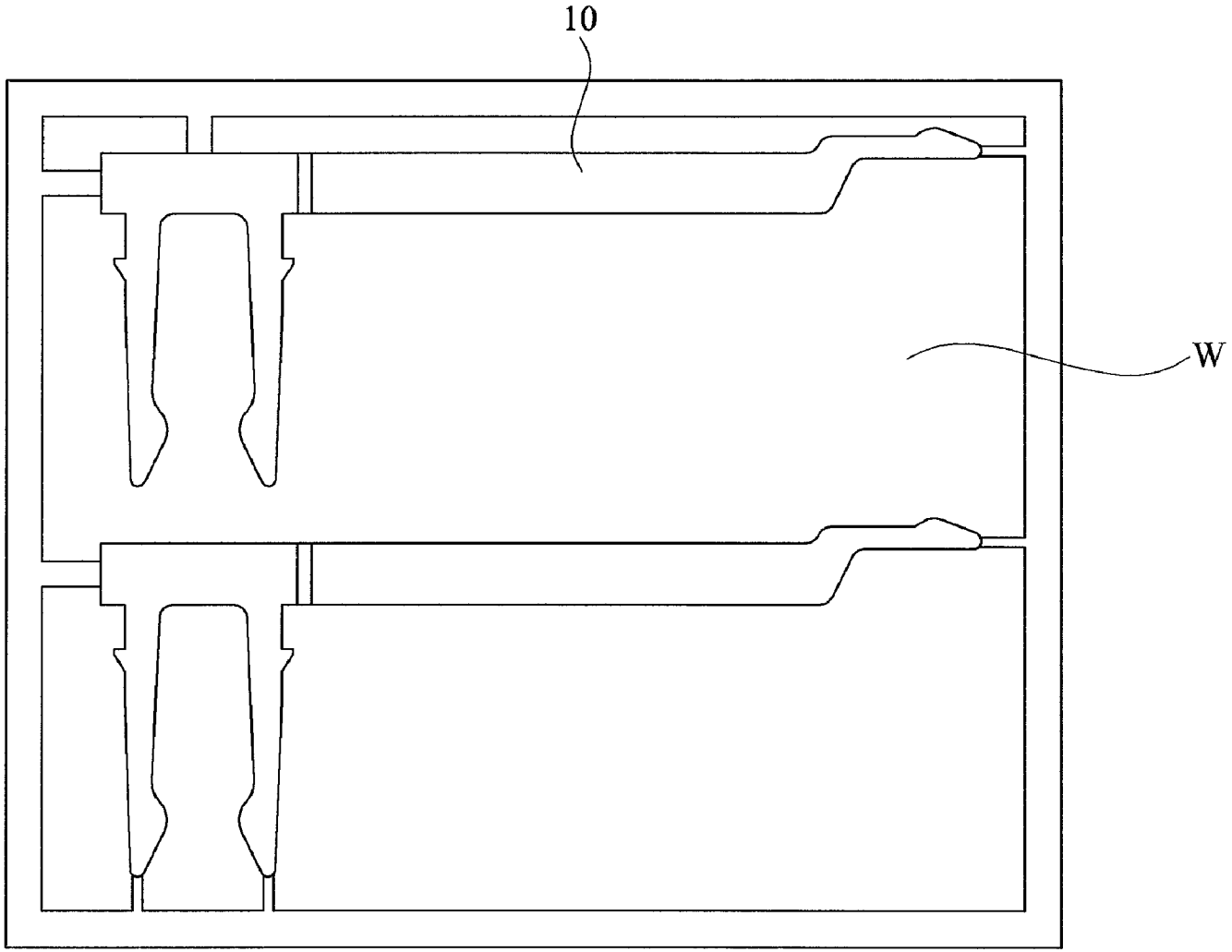
FIG.2(Prior Art)
FIG. 2 illustrates how the signal terminals employed in the conventional socket member are punched via the molding process.

From FIGS. 2, 4 and 5A, one can observe that the first terminal element 241 has a contact area T for contacting with the mating plug member. However, in the prior art socket member, the signal terminals 14 are in contact with the mating plug member only at the thickness of the planar plate 122. Since the contact area T of the first terminal element 241 is relatively larger than the thickness of the planar plate 122, the socket member of the present invention possesses a more stable signal transmission when compared with the prior art ones.

In the prior art socket member, the ground-contact element 12 has large dimension and results in lots of metal plates while the signal terminals 14 are integrally formed and thus a relatively large waste of the metal plate is resulted after the punching and bending processes. In the socket member of the present invention, the first and second terminal elements 241, 242 are interactively clamped together to form the transmission terminals 24. Since the terminal elements 241, 242 are elongated and thin in dimension, several pieces of semi-finished terminal elements 20*a*, 30*a* can be punched out from the thin-and-elongated metal plates 20, 30. There will be little waste resulted after fabrication of the terminal elements 241, 242. Moreover, the soldering sections 2423 of the second terminal elements 242 are used for grounding purposes and since each soldering section 2423 has a relatively small contact area, lots of metal material can be saved. Since the insulated body 21 can be made from a less expensive and low-heat resistant insulated material, the manufacturing expense of the socket member of the present invention can be cut down.

While the invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A socket member comprising:

an insulated body;

at least one connection unit disposed within said insulate body and including a connection body having a first side formed with a through hole, and a fixing seat projecting from said first side of said connection body, and having a reception channel in spatial communication with said through hole; and at least one transmission terminal including a first terminal element having a first connecting section extending into said through hole in said connection body for establishing electrical connection with an inserted plug and a clamping section received within said reception channel of said fixing seat, and a second terminal element having a second connecting section being clamped by said clamping section of said first terminal element and a soldering section for soldering onto a printed circuit board, thereby installing the socket member on the printed circuit board.

2. The socket member according to claim 1, wherein said clamping section of said first terminal element is bifurcated so as to posses first and second clamping strips, which cooperatively clamp said second connecting section of said second terminal element.

3. The socket member according to claim 1, wherein said first terminal element further has first and second engagement protrusions projecting laterally and outwardly from two opposite sides of said clamping section for engaging said reception channel in said fixing seat.

4. The socket member according to claim 3, wherein said fixing seat further has first and second protrusion blocks projecting into said reception channel for engaging said first and second engagement protrusions of said clamping section of said first terminal element once said clamping section is received within said reception channel of said fixing seat.

5. The socket member according to claim 1, wherein said first terminal element further has a resilient section interconnecting said first connecting section and said clamping section, said resilient section having an exterior area greater than an area of cross-section such that said resilient section absorbs a relatively large pressing force once said first connecting section is pressed by the inserted plug.

6. The socket member according to claim 1, wherein said fixing seat further has an engagement channel for receiving said second connecting section of said second terminal element and in spatial communication with and inboard to said reception channel.

7. The socket member according to claim 1, further comprising a limiting plate for holding said insulated body thereon in such a manner that in case the socket member has several pieces of said transmission terminals, said soldering sections of said second terminal element are fixed on said limiting plate.

8. The socket member according to claim 7, wherein said limiting plate is made from high-heat resistant and insulated material.

9. The socket member according to claim 1, further comprising a metal sleeve for sleeving onto said connection unit.

10. The socket member according to claim 9, wherein when the socket member has several pieces of said connection units, several pieces of said metal sleeves are respectively sleeved onto said connection units, said socket member further comprising a connection terminal for coupling an adjacent pair of said metal sleeves and a ground terminal which is electrically coupled to one of said adjacent pair of said metal sleeves.

* * * * *